US006473584B1

(12) United States Patent
Hibino et al.

(10) Patent No.: US 6,473,584 B1
(45) Date of Patent: Oct. 29, 2002

(54) DEVELOPING APPARATUS HAVING CARRYING CAPABILITY OF SCREW LOWERED ON DEVELOPING SLEEVE SIDE

(75) Inventors: Masaru Hibino, Minami Ashigara; Masanori Shida, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/717,336

(22) Filed: Nov. 22, 2000

(30) Foreign Application Priority Data

Nov. 30, 1999 (JP) ..... 11-338876

(51) Int. Cl.[7] ..... G03G 15/08
(52) U.S. Cl. ..... 399/254
(58) Field of Search ..... 399/254–256, 399/274, 275, 273

(56) References Cited

U.S. PATENT DOCUMENTS

| | | | | |
|---|---|---|---|---|
| 4,864,349 A | * | 9/1989 | Ito | 399/256 |
| 5,172,168 A | * | 12/1992 | Satoh et al. | 399/223 |
| 5,438,394 A | | 8/1995 | Suzuki et al. | |
| 5,459,559 A | | 10/1995 | Nagase et al. | |
| 5,576,812 A | | 11/1996 | Hibino et al. | |
| 5,870,656 A | | 2/1999 | Hibino et al. | 399/149 |
| 6,049,687 A | | 4/2000 | Hibino et al. | 399/270 |
| 6,104,892 A | | 8/2000 | Kobayashi et al. | 399/63 |
| 6,249,664 B1 | * | 6/2001 | Sato | 399/254 |

FOREIGN PATENT DOCUMENTS

| | | | | |
|---|---|---|---|---|
| JP | 04204464 A | * | 7/1992 | G03G/15/08 |
| JP | 06089061 A | * | 3/1994 | G03G/15/08 |
| JP | 06208294 A | * | 7/1994 | G03G/15/08 |
| JP | 07013420 A | * | 1/1995 | G03G/15/08 |

* cited by examiner

*Primary Examiner*—Robert Beatty
(74) *Attorney, Agent, or Firm*—Fitzpatrick, Cella, Harper & Scinto

(57) ABSTRACT

A developing apparatus includes a developer carrying body, opposed to an image bearing body bearing an electrostatic image, for carrying a magnetic developer, a regulating member, provided under the developer carrying body, for regulating an amount of the developer on the developer carrying body, a first magnetic pole provided in the developer carrying body and near a portion regulated by said regulating member, a second magnetic pole, provided at an upstream side of the first magnetic pole in a moving direction of the developer carrying body, for forming a repulsive magnetic field with the first magnetic pole, a first screw for agitating and carrying a developer dropped from the developer carrying body by the repulsive magnetic field, and a second screw for forming a developer circulating path with the first screw and receiving a replenished developer, wherein the first screw has a developer carrying capability lower than a developer carrying ability of the second screw. The second screw has a blade portion 25% or more of which is exposed above the surfaced developer.

17 Claims, 3 Drawing Sheets

DEVELOPING APPARATUS HAVING CARRYING CAPABILITY OF SCREW LOWERED ON DEVELOPING SLEEVE SIDE

BACKGROUND OF THE INVENTION

1. Field of the Invention

The present invention relates to a developing apparatus which is used in an electrophotography type or an electrostatic recording type image forming apparatus for developing an electrostatic image on an image bearing body.

2. Related Background Art

Conventionally, developing apparatuses which are provided in image forming apparatuses adopting electrophotography are roughly classified into a developing apparatus which uses a single-component developing method and a developing apparatus which uses two-component developing method.

Most of the developing apparatuses which use the single-component developing method adopt a noncontact type method. A typical developing method includes a jumping developing method using a magnetic toner.

According to the single-component developing method, high quality images can be provided with a simple configuration, but it is difficult to provide color images. According to the single-component developing method using a nonmagnetic toner, color images can be provided, but it is difficult to apply the toner on a surface of a developing sleeve used as a developer carrying body and coating is performed by means of an elastic blade under current circumstances, thereby reducing a security and a durability.

On the other hand, the developing apparatus which adopts the two-component developing method carries a toner to a developing region with a magnetic carrier and develops a latent image by bringing a developer into contact with a photosensitive drum which bears the latent image.

Now, a description will be made of the developing steps of the two-component developing method with reference to FIG. 4.

As shown in FIG. 4, a developing apparatus which adopts the two-component developing method has a developing sleeve 30 which carries a developer, a magnet roller 35 which is magnetic field producing means disposed in the developing sleeve 30 and having a plurality of magnetic poles (pole N1, pole N2, pole N3, pole S1 and pole S2) in a circumferential direction, agitating screws 31 and 32 which comprise an agitating and carrying means, a regulating blade 33 which is disposed as developer regulating means for forming a thin layer of the developer on a surface of the developing sleeve 30, and a developer container 34.

A description will be made here of a developing step of visualizing an electrostatic latent image on a photosensitive drum by a two-component magnetic brush method and a circulating system of the developer.

In such a developing apparatus, the developer which is drawn up by the pole N3 is first formed into a thin layer on the developing sleeve 30 by being regulated its layer thickness with the regulating blade 33 at a process where the developer is carried from the pole S2 to the pole N1 as the developing sleeve 30 rotates.

When the developer formed into the thin layer is carried to the pole S1 which is a main developing pole, an ear is formed on the developing sleeve 30 by a magnetic force.

An electrostatic latent image formed on the photosensitive drum is developed by the developer which is formed into the ear, and then the developer on the developing sleeve 30 is returned into the developer container 34 by a repulsive magnetic field produced by the poles N3 and N2.

As described above, the two-component developing method generally uses magnetic poles which have an identical polarity and are arranged adjacent to one another in a circumferential direction, and once takes a developer after development off a developing sleeve by a repulsive magnetic field produced by these repulsive magnetic poles so as not to allow a hysteresis of an image to remain.

A DC bias voltage and an AC bias voltage are applied to the developing sleeve 30 from a power source (not shown). The two-component developing method generally enhances a developing efficiency and an image quality by applying the AC bias voltage.

As methods to form the latent image on the photosensitive drums, methods are known wherein a photosensitive drum, which is the electrophotographic photosensitive body, is scanned by and exposed to laser beams modulated in correspondence to image signals to be recorded whereby the electrostatic latent image is formed in the form of distributed dots or dots distributed so as to correspond to images. Among these methods, a so-called pulse width modulation (PWM) method which modulates a width of a driving pulse current (duration time) of a laser in correspondence to a shading of an image to be recorded is capable of providing high recording density (that is, high resolution) and a high gradation.

By the way, the developing apparatuses which adopt the two-component developing method have recently been configured so as to be more compact and have longer service lives.

To configure these developing apparatuses compact in regard to a developing process, it is necessary to configure a more compact developer container, a developing sleeve, an agitating and carrying screw, and the like. Furthermore, it is also effective to reduce a space of a developer reservoir in the vicinity of the developer layer thickness regulating portion of the regulating blade 33. For compact configurations of these members and saving of space, it is required to manufacture parts and set various kinds of latitudes with more precision and to make various contrivances.

Furthermore, in order to obtain a longer service life, it is necessary to prevent a toner and a carrier from being deteriorated. For this purpose, the developing apparatus must be configured so as not to compress the developer. The developer container allows the developer to be compressed in the developer layer thickness regulating portion, which is located on the upstream side of the regulating blade 33 in a rotating direction of the developing sleeve in an ordinary configuration, and the developer which is attracted by a developer layer thickness regulating pole is compressed in this region between the developing sleeve and the developer container.

To lessen compression of the developer, it is effective to weaken a force Fr of the developer layer thickness regulating pole which attracts the developer to the developing sleeve (a magnetic attractive force exerted perpendicularly to the developing sleeve). Methods to weaken the force Fr includes methods in which magnetization of the magnetic carrier in a developer is lowered (lowering of magnetization of the carrier weakens a force of rubbing the toner image developed on the photosensitive drum in a developing portion, thereby enhancing an image quality) and methods in which a magnet pattern is configured so that a line of magnetic force emitted from the developer layer thickness regulating pole hardly turns to adjacent magnetic poles and emerges from an outer circumferential surface of a developing sleeve as perpendicularly as possible. As one of the latter methods, there has been proposed a developing method which uses one of repulsive magnetic poles of the developing sleeve as the developer layer thickness regulating pole.

When a repulsive magnetic field is produced by magnetic poles which have an identical polarity and are adjacent in a circumferential direction, a line of magnetic force is emitted from each magnetic pole nearly perpendicularly to the outer circumferential surface of the developing sleeve (in a radial direction of the developing sleeve). In this case, a magnetic flux density changes at a low ratio in a direction perpendicular to the outer circumferential surface of the developing sleeve. As a result, the force which attracts the developer to the surface of the developer sleeve is weakened, thereby lowering a compression degree of the developer. (Such a configuration facilitates drawing up the developer to coat the developing sleeve and is simple when the developer layer thickness regulating pole which is one of the repulsive magnetic poles is disposed lower in a direction of gravity than a stripping pole which is the other magnetic pole for producing the repulsive magnetic field. Furthermore, the configuration may allow a volume of the developer reservoir in the developer layer thickness regulating portion to be decreased and serve for compact configuration of the developing apparatus.) It is needless to say that the service life of the developing apparatus can be prolonged by adopting both methods described above.

However, such a developing apparatus may cause a screw-pitch-like optical density ununiformity to be produced at a rear end of a black solid image when the developing apparatus has the above described configuration, that is, a configuration in which the sleeve has a small diameter and one of the repulsive magnetic poles is used as the developer layer thickness regulating pole. This phenomenon takes place because a mixing ratio between the developer which moves to the developer layer thickness regulating pole after being stripped by the repulsive magnetic field and contains the toner at a lowered concentration (with an image hysteresis) and the developer which is agitated and carried by a screw in the vicinity of the developing sleeve to be supplied to the developer layer thickness regulating pole varies at a screw rotation period in a longitudinal direction of an image region.

The above described phenomenon is likely to take place when the agitating and carrying screw is disposed in the vicinity of the developer layer thickness regulating pole and the developer has a relatively low surface in the vicinity of the developing sleeve. Furthermore, the above described phenomenon is also likely to take place when the magnetic carrier is magnetized at a low degree. This is because the developer is likely to move to the developer layer thickness regulating pole after the developer is stripped by the stripping pole after development, and when the carrier is magnetized at a low degree, the developer is insensitive to the magnetic field and likely to move to the developer layer thickness regulating pole without being stripped by the stripping pole.

As a measure to prevent this phenomenon, it is effective to raise a surface of the developer in the vicinity of the developing sleeve. When the surface is raised, the developer can hardly move to the developer layer thickness regulating pole after being stripped by the repulsive magnetic field after the development due to hindrance by the developer, thereby making it possible to suppress the screw-pitch-like optical density ununiformity.

When, however, an amount of the developer contained in the developer container is simply increased to raise the surface of developer in the vicinity of the developing sleeve, and a continuous durability test of a high image ratio is performed, the result is that the replenished toner is less agitated, an image optical density is increased, and a fog is aggravated because a surface of the developer in the vicinity of a screw which is away from the developing sleeve is also raised, although screw-pitch-like optical density ununiformity was eliminated.

SUMMARY OF THE INVENTION

An object of the present invention is to provide a developing apparatus which has high performance to agitate a replenished toner.

Another object of the present invention is to provide a developing apparatus which prevents a fog.

Still another object of the present invention is to provide a developing apparatus configured to allow a carrying screw which receives a developer by the action of a repulsive magnetic field to have a carrying speed lower than a carrying speed of a carrying screw which receives a replenished toner.

A further object of the present invention will be apparent from the following description.

DESCRIPTION OF THE PREFERRED EMBODIMENTS

Now, embodiments of the present invention will be described with reference to the accompanying drawings.

(First Embodiment)

Figure 1:
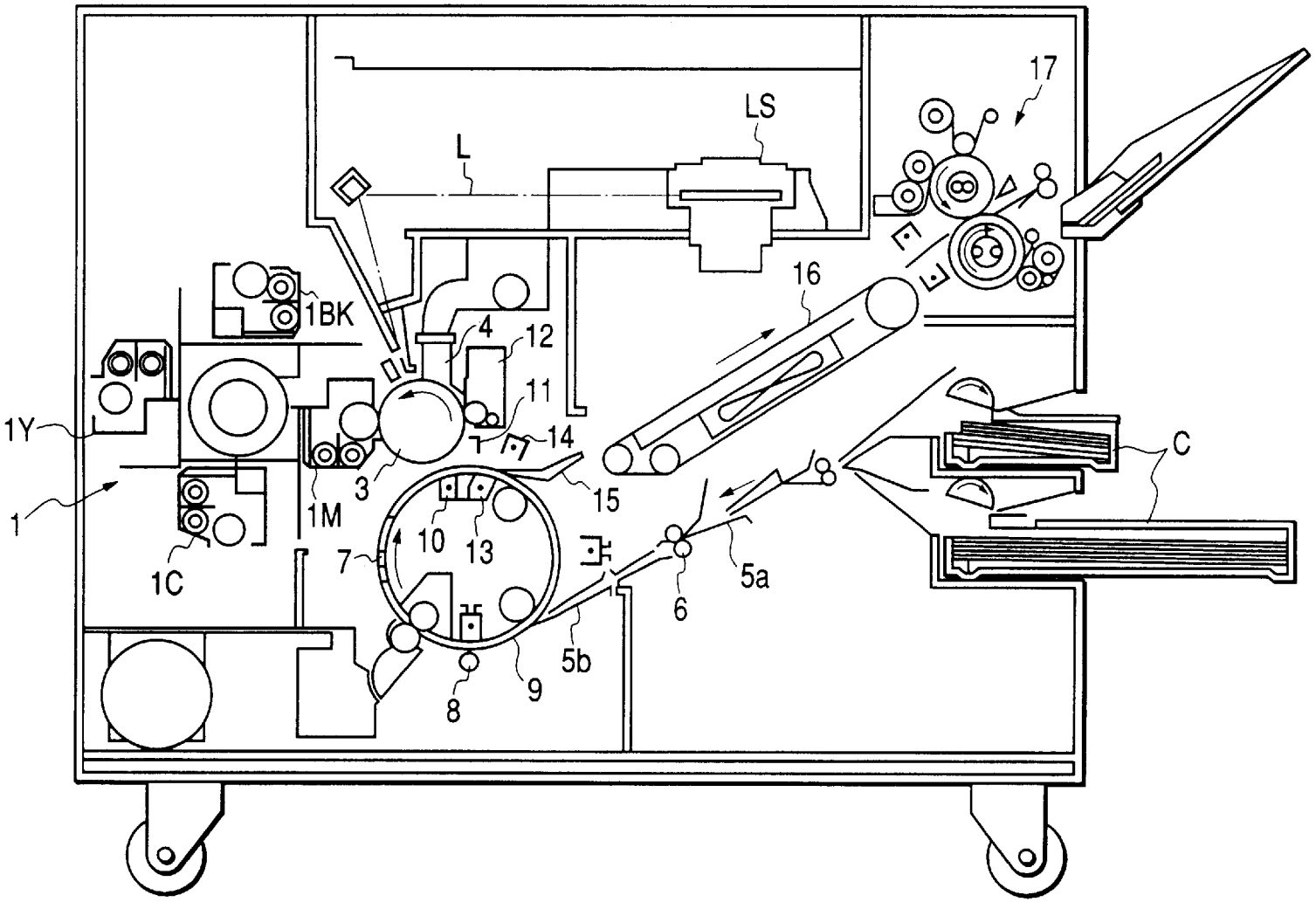
FIG. 1 is a sectional view schematically showing a configuration of a full color printer as an example of image forming apparatus according to a first embodiment of the present invention.

FIG. 1 is a sectional view schematically showing a configuration of a color printer of electrophotography type (hereinafter referred to as a printer) as an example of an image forming apparatus according to a first embodiment of the present invention.

As shown in FIG. 1, the printer comprises an electrophotography photosensitive drum (hereinafter referred to as a photosensitive drum) 3 which is a latent image bearing body which rotates in a direction indicated by an arrow, arranged around which is image forming means consisting of an electrifier 4, a developing apparatus 1 having developing devices 1M, 1C, 1Y and 1Bk, a transfer electrifier 10, cleaning means 12, and LED exposure means which is shown in this drawing to be disposed above the photosensitive drum 3.

Each developing device contains a two-component developer containing toner particles and carrier particles. The developer in the developing device 1M contains a magenta toner, the developer in the developing device 1C contains a cyan toner, the developer in the developing device 1Y contains a yellow toner, and the developer in the developing device 1BK contains a black toner.

An original to be copied is read by an original reader (not shown). This original reader has a photoelectric converter element such as CCD which converts an original image into electric signals, and outputs image signals corresponding to magenta image information, cyan image information, yellow image information and black-white information of the original, respectively. The LED exposure means is subjected to light emission on-off control for exposure in correspondence to these image signals. In addition, the image forming apparatus is capable of printing out output signals from an electronic computer.

An operating sequence of the color printer as a whole now will be described taking a full color mode as an example.

First, a surface of the photosensitive drum 3 is uniformly charged (electrified) by the charging device (electrifier) 4. Then, exposure is performed with an LED array L controlled by a magenta image signal, a latent image in the form of distributed dots is formed on the photosensitive drum 3, and this latent image is reversal-developed by the magenta developing device 1M which is preliminarily disposed selectively so as to oppose to a developing location.

A transferring material, which is a recording medium such as paper, taken out of a cassette C and fed by way of a sheet feeding guide 5*a*, a sheet feeding roller 6 and a sheet feeding guide 5*b* is held by a gripper 7 of a transferring drum 9, and electrostatically wrapped around the transferring drum 9 by a contact roller 8 and an electrode opposed to the contact roller 8.

The transferring drum 9 is rotating in a direction indicated by the shown arrow in synchronization with the photosensitive drum 3 and the magenta visualized image developed by the magenta developing device 1M is transferred to the transferring material by a transferring charging device (electrifier) 10 in a transferring portion. The transferring drum 9 continues to rotate and is ready for transfer of a next color image (cyan in the embodiment shown in FIG. 1).

On the other hand, electricity of the photosensitive drum 3 is removed by the electrifier 11, and the photosensitive drum 3 is cleaned by the cleaning means 12, electrified once again by the electrifier 4 and exposed by the LED array L which is controlled by a next cyan image signal as described above, whereby an electrostatic latent image is formed. In this while, the developing apparatus 1 rotates to selectively dispose the cyan developing device 1C at a predetermined developing location, reverses and develops the electrostatic latent image corresponding to a cyan color, thereby forming a visualized cyan image.

Then, the color printer performs steps similar to those described above for a yellow image signal and a black image signal, and upon completing transfer of four visualized color images (toner images), electricity of the transferring materials is removed by the electrifiers 13 and 14, and the transferring materials are released from the gripper 7, separated from the transferring drum 9 by a separating claw 15 and sent to a fixing device (hot pressing roller fixing device) 17 by a carrying belt 16. The fixing device 17 fixes the visualized images of the four colors which are superimposed on the transferring materials. Thus, a series of full color print sequence terminates and a desired full color image is printed.

The above described configuration is only an example and the color printer may have various configurations in which, for example, electrifier 4 is not a corona electrifier but an electrifying roller, the exposure means is a semiconductor laser, and the transferring electrifier 10 is a transferring roller, but an image is formed essentially through steps of charging (electrification), exposure, developing, transferring and fixing.

Now, the developing device IM which is a member of the developing apparatus according to the present invention will be described with reference to the accompanying drawings.

Figure 2:
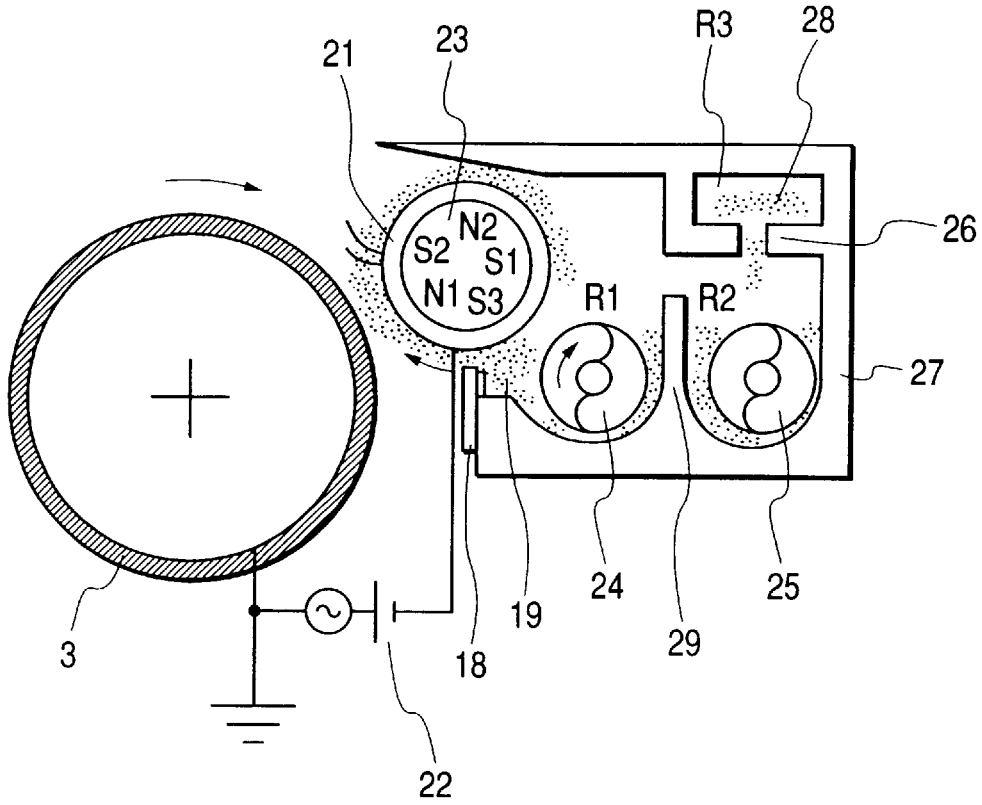
FIG. 2 is a sectional view schematically showing a configuration of a developing apparatus disposed in the image forming apparatus shown in FIG. 1.

FIG. 2 is a configurational diagram of the developing device 1M used in the embodiment of the present invention.

The developing device 1M has a developer container 27 as shown in FIG. 2.

An interior of the developer container 27 is divided by a partition 29 into a developing chamber (first chamber) R1 and an agitating chamber (second chamber) R2, a toner storage chamber R3 is formed above the agitating chamber R2 with the partition 29 interposed, and a replenishing toner (nonmagnetic toner) 28 is accommodated in the toner storage chamber R3. In addition, a replenishing port 26 is formed in the partition 29 so that the replenishing toner 28 is dropped and replenished into the agitating chamber R2 through the replenishing port 26 in an amount corresponding to consumed toner.

In contrast, a developer 19 is accommodated in the developing chamber R1 and the agitating chamber R2. The developer 19 is a two-component developer consisting of a toner having an average particle diameter of 8 $\mu$m prepared by a grinding method to which titanium oxide having an average particle diameter of 20 $\mu$m is added at 1% by weight and a magnetic carrier which has a value of magnetization of 270 emu/cm$^3$ ($1080\pi\times10^{-4}=1\times10^{-1}$ T) and an average particle diameter of 35 $\mu$m (a mixing ratio is selected so that the developer contains the nonmagnetic toner approximately 7% by weight).

An opening is formed in the developer container 27 at a location close to the photosensitive drum 3 and a developing sleeve 21 protrudes outside through the above described opening. The developing sleeve 21 is rotatably incorporated in the developer container 27 and made of a nonmagnetic material such as SUS305AC, for example, in this embodiment, and a magnet 23 is fixed in the developing sleeve 21 as magnetic field producing means. The developing sleeve 21 has a diameter of 16 mm.

A developing sleeve which has a small diameter of 10 to 25 mm makes it possible to configure the developing device more compact but is likely to allow fog to be easily produced.

The magnet 23 has a developing magnetic pole N1, a developer layer thickness regulating pole S3 located on the downstream side of the pole N1, and magnetic poles N2, S2 and S1 for carrying the developer 19. The magnet 23 is disposed and fixed in the developing sleeve 21 so as to oppose the developing magnetic pole N1 to the photosensitive drum 3. The developing magnetic pole N1 produces a magnetic field in the vicinity of a developing portion between the developing sleeve 21 and the photosensitive drum 3, thereby forming a magnetic brush with the above described magnetic field. At a location of the developing portion, the developer which is carried in a direction indicated by an arrow as the developing sleeve 21 rotates is brought into contact with the photosensitive drum 3, whereby an electrostatic latent image on the photosensitive drum 3 is developed. At this time, the developing sleeve 21 and the photosensitive drum 3 move in directions opposite to each other (counter directions) at a location where the developing sleeve 21 and the photosensitive drum 3 are close to each other (developing portion). The developer which has completed developing with the pole N1 is stripped off the developing sleeve 21 by a repulsive magnetic field produced by the poles S1 and S3 which are repulsive magnetic poles and dropped into the developing chamber R1.

An oscillating bias voltage which is an AC voltage on which a DC voltage is superimposed is applied to the developing sleeve by a power source 22. A potential at a dark portion (potential at a portion which is not exposed) and a potential at a light portion (potential at a portion which is exposed) of a latent image lie between a maximum value and a minimum value of the above described oscillating bias voltage. Accordingly, formed in the developing portion is an alternating electric field whose a direction changes alternately. In this alternating electric field, the toner and the carrier are oscillated intensely, whereby the toner overcomes electrostatic restriction to the sleeve and the carrier and adheres to the photosensitive drum in an amount corresponding to a potential of the latent image. In the embodiment, a potential at a dark portion of the photosensitive drum is set to −550 V, a potential at a light portion is set to −100 V, and −300 V and Vpp 2.0 kV, frequency of 6 kHz are applied to the developing sleeve as the DC bias voltage and the AC bias voltage, respectively.

Disposed under the developing sleeve 21 is a blade 18 spaced apart from the developing sleeve 21 as developer regulating means by a predetermined distance. The distance between the developing sleeve 21 and the blade 18 is 400 μm. The blade 18 is fixed to the developer container 27. The blade 18 is made of a magnetic material such as iron and magnetically regulates a layer thickness of the developer 19 on the developing sleeve 21.

The developer chamber R1 accommodates a carrying screw 24 as first agitating and carrying means. The carrying screw 24 has spiral blades disposed on a shaft having a diameter of 6 mm, and the spiral blades have a diameter of 14 mm and are disposed at a pitch of 15 mm.

A carrying screw which has a small diameter of 10 to 25 mm permits configuring the developing device more compact but makes good circulation hardly compatible with prevention of fog.

The carrying screw 24 is rotated in a direction indicated by the arrow shown in FIG. 2 and the developer 19 in the developing chamber R1 is carried in a longitudinal direction of the developing sleeve 21 by rotational driving force of the carrying screw 24. In the embodiment, the carrying screw 24 is disposed below the developing sleeve 21 in a direction of gravity. This is because an uppermost surface of the developer accommodated in the carrying screw 24 is located between the pole S3 which is the developer layer thickness regulating pole and the pole S1 which is the stripping pole as described later.

A carrying screw 25 is accommodated in the agitating chamber R2 as second agitating and carrying means. The carrying screw 25 has a shape which is identical to that of the carrying screw 24, and it has spiral blades disposed on a shaft having a diameter of 6 mm, and the blades have a diameter of 14 mm and are arranged at a pitch of 20 mm. The carrying screw 25 carries the toner dropped through the replenishing port 26 in the longitudinal direction of the developing sleeve 21 while agitating and delivers the developer sufficiently agitated into the developing chamber R1 at the end of the delivery.

Now, a description will be made in detail of a positional relationship between the stripping pole which forms the repulsive magnetic field in cooperation with the developer layer thickness regulating pole and the screw in the vicinity of the developing sleeve in the developing device used in the embodiment of the present invention.

Out of the pole S3 and pole S1 which form the repulsive magnetic field, the pole S3 is used as the developer layer thickness regulating pole and the pole S1 is used as the developer stripping pole in the embodiment. It is preferable that a peak value of a magnetic field intensity of the pole S3 is not lower than 400 gauss ($4\times10^{-2}$ T) and not higher than 1000 gauss ($1\times10^{-1}$ T) in a direction perpendicular to an outer circumferential surface of the developing sleeve 21 (radial direction), and that a peak value of a magnetic field intensity of the pole S1 is not lower than 400 gauss and not higher than 800 gauss ($8\times10^{-2}$ T) in the direction perpendicular to the outer circumferential surface of the developing sleeve 21. In the embodiment, a peak value of the magnetic field intensity of the pole S3 was 600 gauss ($6\times10^{-2}$ T) and a peak value of the magnetic field intensity of the pole S1 was 500 gauss ($5\times10^{-2}$ T). Furthermore, the embodiment adopts a positional relationship between the pole S3 and the pole S1 on the developing sleeve 21 where a location at which the magnetic field intensity of the pole S1 which is the stripping pole has the peak position in the direction perpendicular to the outer circumferential surface of the developing sleeve 21 is higher in the direction of gravity than a location at which the magnetic field intensity of the pole S3 which is the developer layer thickness regulating pole has the peak position in the direction perpendicular to the outer circumferential surface of the developing sleeve 21. Such a configuration facilitates to drop developer after developing (no special stripping means required), adsorb the developer by magnetically attracting by the developer layer thickness regulating pole and carry the developer to the developing portion.

That is, the above described positional relationship makes it easy to provide a configuration which is simple and convenient for stripping the developer from the developing sleeve and supplying the developer to the developing sleeve.

Furthermore, an angle of 5° is formed between a location at which the magnetic field intensity of the pole S3 has the peak position in the direction perpendicular to the outer circumferential surface of the developing sleeve 21 and a tip of the blade 18 (on a side of the developing sleeve 21) taking a center of the developing sleeve 21 as the reference in the embodiment.

Since the repulsive magnetic field is formed between the pole S3 and the pole S1, lines of magnetic force of the pole S3 tend to diverge in the direction perpendicular to the outer circumferential surface of the developing sleeve 21. As a result, a variation ratio of the magnetic field (a density of lines of magnetic force) is lowered in the direction perpendicular to the outer circumferential surface of the developing sleeve 21. The lowering of the variation ratio corresponds to weakening of the force with which the developing sleeve 21 attracts the developer. The above described configuration of the developing device weakens a force of the developer layer thickness regulating pole to compress the developer, thereby preventing the developer from being deteriorated due to a deteriorated toner and a spent carrier and prolonging a service life of the developer.

Conventionally, however, in the case where one of repulsive magnetic poles is used as a developer layer thickness regulating pole and an agitating and carrying screw is disposed in the vicinity of the developer layer thickness regulating pole, the screw-pitch-like optical density ununiformity is produced at a rear end of a black solid image when a surface of a developer is relatively low in the vicinity of a developing sleeve. This phenomenon takes place due to a variation of a mixing ratio which is caused at a rotation period of the screw in a longitudinal direction of an image region when a developer which is stripped by the repulsive magnetic field after developing and moved to the developer layer thickness regulating pole is mixed with a developer which is agitated and carried by the screw and supplied to the developer layer thickness regulating pole. When a toner concentration in the stripped developer is low at the rear end of the image in particular, the optical density ununiformity tends to be remarkable.

Several examinations provided a result that the screw-pitch-like optical density ununiformity is not produced when the surface of the developer is set in the vicinity of the developing sleeve as described below. That is, between the location at which the magnetic field intensity of the developer layer thickness regulating pole has the peak position in the direction perpendicular to the outer circumferential surface of the developing sleeve and the location at which the magnetic field intensity of the stripping pole has the peak position in the direction perpendicular to the outer circumferential surface of the developing sleeve, the surface of the developer is set higher than a level at which the magnetic field of the developer layer thickness regulating pole has an intensity of 200 gauss ($200\times10^{-4}=2\times10^{-2}$ T) in the direction perpendicular to the outer circumferential surface of the developing sleeve. When the surface of the developer is set as described above, the developer hinders the stripped developer from moving to the developer layer thickness regulating pole, thereby allowing the developer which is supplied to the developer layer thickness regulating pole to be mixed at a ratio higher than that of the stripped developer which has an image hysteresis after being stripped. The above described surface of the developer is defined as the level at which the magnetic field of the developer layer thickness regulating pole has the intensity of 200 gauss in the direction perpendicular to the outer circumferential surface of the developing sleeve between the location at which the magnetic field intensity of the developer layer thickness regulating pole has the peak value in the direction perpendicular to the outer circumferential surface of the developing sleeve and the location at which the magnetic field intensity of the stripping pole has the peak value in the direction perpendicular to the outer circumferential surface of the developing sleeve because the developer tends to be attracted to the developer layer thickness regulating pole after being stripped when the surface of the developer is defined as a level at which a density of magnetic flux is not lower than 200 gauss.

The embodiment which adopts the above described configuration does not allow the screw-pitch-like optical density ununiformity to be produced.

However, simple increase of an amount of the developer to raise a surface of the developer in the screw in the vicinity of the developing sleeve (a surface of the developer on a side of the developing chamber) simultaneously raises a surface of the developer also on a side of the agitating chamber. As a result, the replenishing toner is not agitated sufficiently on the side of the agitating chamber, thereby posing a problem of an increased optical density of image, a problem of toner splashing from the developing sleeve, a problem of fog and so on.

The embodiment therefore set a developer carrying speed on the side of the developing chamber to be lower than that on the side of the agitating chamber so that a surface of the developer on the side of the developing chamber is raised and a surface of the developer on the side of the agitating chamber is lowered, thereby obtaining compatibility between optical density uniformity in a black solid area and an enhancement of an agitation of the replenishing toner. An essential condition for the enhancement of the agitation is to lower a surface of the developer on the side of the agitating chamber below a top of the blade of the screw.

Figure 3:
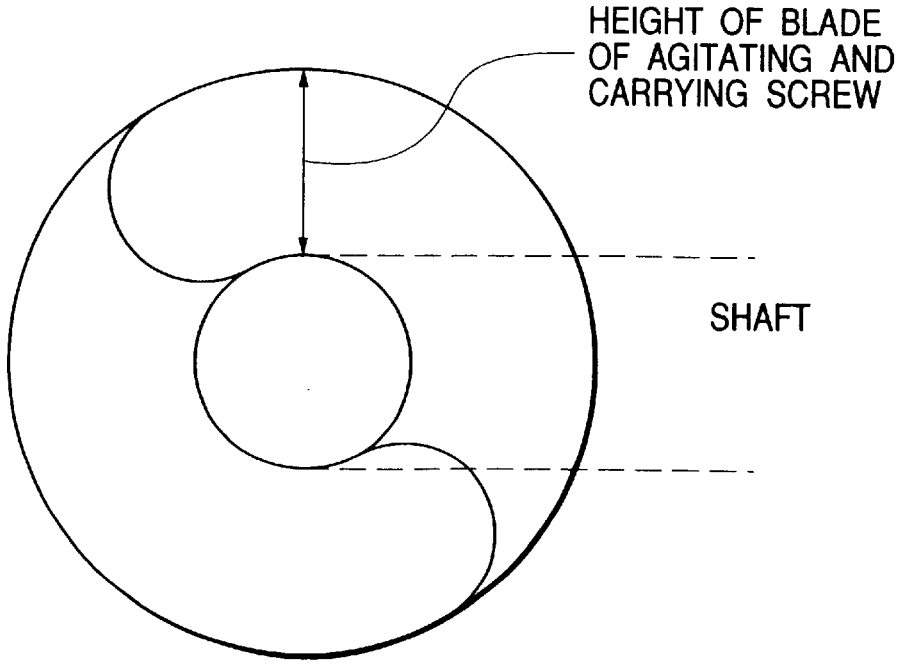
FIG. 3 is a schematic sectional view of agitating and carrying means disposed in the developing apparatus shown in FIG. 2.
Figure 4:
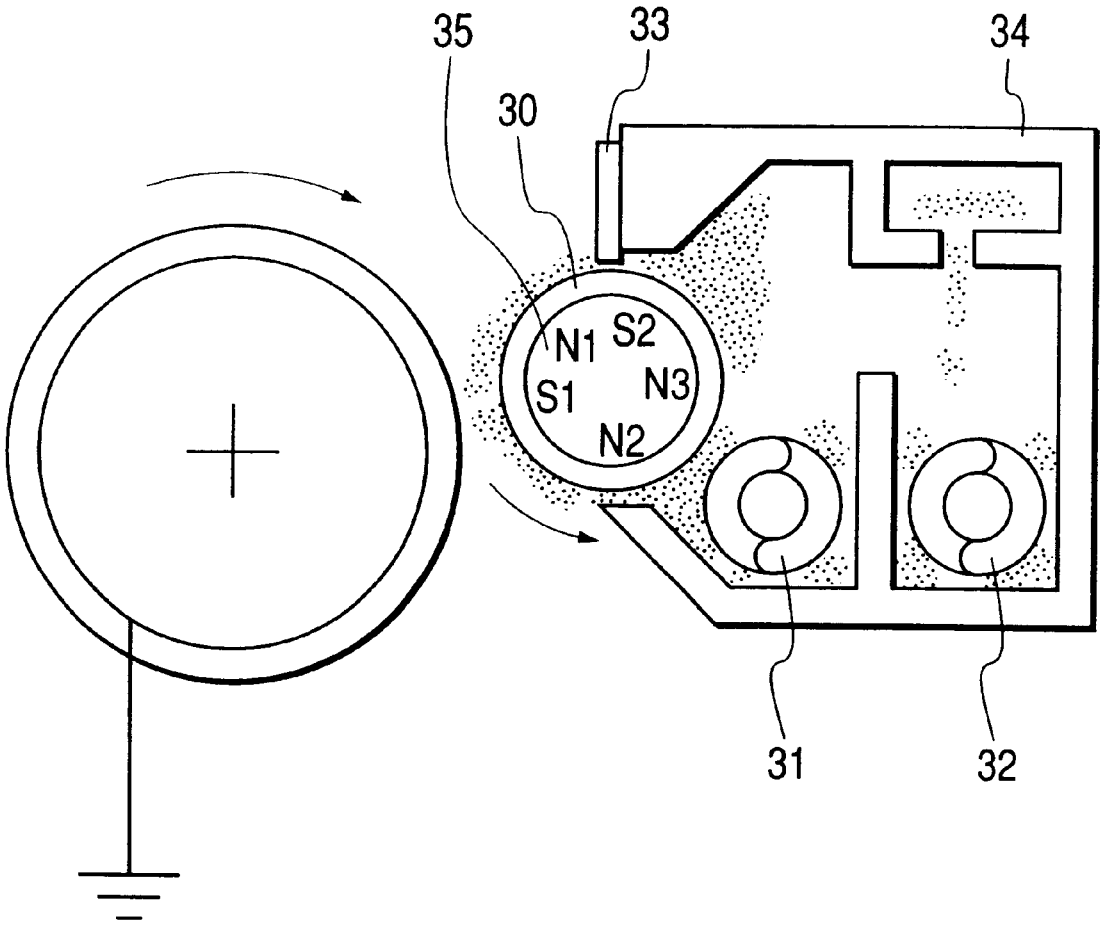
FIG. 4 is a sectional view schematically showing a configuration of a conventional developing apparatus.

Several examinations indicated that a replenishing toner corresponding to any high image ratio can be agitated sufficiently when 25% or more of a height 1 of the blade (shown in FIG. 3., 4 mm in case of a screw diameter of 14 mm and a shaft diameter of 6 mm) is visible above a surface of the developer in a vertical direction. The inventors herein rotated only the developing device at idle for two minutes in an environment of 23° C./5%, stopped driving the developing device, and surveyed one minute after how the blade was seen.

In the embodiment, the carrying speeds of the developer are changed by selecting a pitch of 15 mm for the blades of the agitating and carrying screw on the side of the developing chamber and a larger pitch of 20 mm on the side of the agitating chamber as described above, thereby setting the surfaces of the developer high on the side of the developing chamber and low on the side of the agitating chamber.

Accordingly, the embodiment makes it possible to obtain compatibility between prevention of the screw-pitch-like optical density ununiformity and enhancement of agitation of the developer in the developer container while configuring a developing device compact and prolonging a service life of the developing device by using the agitating screw 24 which agitates the developer in the vicinity of the developing sleeve 21 and carries the developer in a predetermined direction and the agitating screw 25 which agitates the developer on a side far from the developing sleeve 21 of the agitating screw 24 and carries the developer in a predetermined direction, and setting a developer carrying speed of the agitating screw 25 to be lower than that of the agitating screw 24.

Comparative Example 1

In this comparative example, a pitch of 15 mm was selected for blades of an agitating and carrying screw on a side of the developing chamber and a pitch of 15 mm was selected on a side of the agitating chamber in the configuration of the first embodiment. A remainder of the configuration was the same as that in the first embodiment. In the configuration of the comparative example 1, screw-pitch-like optical density ununiformity was produced in the course of output of a blade solid image of A4 size using a developer in an amount of 170 g.

Comparative Example 2

This comparative example had a configuration which was the same as that of the comparative example 1 but used a developer in an amount of 220 g. An output of a black solid image of A4 size provided a result free from screw-pitch-like optical density ununiformity. When 1000 originals having an image ratio of 30% were fed in an environment of 23° C./5%, however, the comparative example 2 produced fog and scattering as well as increase of optical density of image on the order of 0.25.

(Second Embodiment)

Now, a description will be made of a second embodiment of the present invention. Members which are similar to those of the first embodiment will be denoted by the same reference characters without particular description.

In the second embodiment, blades having a diameter of 13 mm were disposed at a pitch of 15 mm on the agitating and carrying screw (the screw shaft having a diameter of 6 mm) on the side of the developing chamber, blades having a diameter of 14 mm were disposed at a pitch of 20 mm on the agitating and carrying screw on the side of the agitating chamber, and a rib 4 mm wide by 4 mm high by 1 mm thick (a plate-like member resisting carriage of a developer) was disposed on the screw on the side of the agitating chamber in the configuration of the first embodiment. Remainder of the configuration was the same as that of the first embodiment. As a result of outputting a black solid image of A4 size from the configuration of the second embodiment using a developer in an amount of 200 g, no screw-pitch-like optical density ununiformity was produced in any condition. Furthermore, fog or scattering was not produced and optical density was stable for a long time during a replenishing durability test at an image ratio of 100% in an environment of 23° C./5%.

(Third Embodiment)

Now, a description will be made of a third embodiment of the present invention. Members which are similar to those of the first embodiment will be denoted by the same reference characters without particular description.

In the third embodiment, blades having a diameter of 14 mm were disposed at a pitch of 15 mm on the agitating and carrying screw (the screw shaft having a diameter of 6 mm) on the side of the developing chamber, blades having a diameter of 14 mm were disposed at a pitch of 15 mm on the agitating and carrying screw on the side of the agitating chamber, and a gear ratio between the screw on the side of the developing chamber and the screw on the side of the agitating chamber was set so that a rotational speed was 40% higher on the side of the agitating chamber in the configuration of the first embodiment. The third embodiment has a configuration which is the same as that of the first embodiment in other respects. As a result of outputting a black solid image of A4 size from the configuration of the third embodiment using a developer in an amount of 200 g, no screw-pitch-like optical density ununiformity was produced in any condition. Furthermore, fog or scattering was not produced and optical density was stable for a long time during a replenishing durability test at an image ratio of 100% in an environment of 23° C./5%.

While the embodiments of the present invention have been described above, the present invention is not limited to the embodiments, and may be modified in any ways within a technical idea of the present invention.

What is claimed is:

1. A developing apparatus comprising:

a developer carrying body, opposed to an image bearing body bearing an electrostatic image, for carrying a magnetic developer;

a regulating member, provided under said developer carrying body, for regulating an amount of the developer on said developer carrying body;

a first magnetic pole provided in said developer carrying body and near to a portion regulated by said regulating member;

a second magnetic pole, provided at an upstream side of said first magnetic pole in a moving direction of said developer carrying body, for forming a repulsive magnetic field with said first magnetic pole;

a first screw for agitating and carrying a developer dropped from said developer carrying body by the repulsive magnetic field; and a second screw for forming a developer circulating path with said first screw and receiving a replenished developer, wherein said first screw has a developer carrying capability lower than a developer carrying capability of said second screw, and wherein said second screw has a blade portion 25% or more of which is exposed above a surface of the developer.

2. A developing apparatus according to claim 1, wherein a developer-carrying speed of said first screw is lower than a developer-carrying speed of said second screw.

3. A developing apparatus according to claim 2, wherein a pitch of said first screw is smaller than a pitch of said second screw.

4. A developing apparatus according to claim 1, wherein the developer includes a magnetic carrier and a toner, and said second screw is replenished with the toner.

5. A developing apparatus according to claim 1, wherein a diameter of said developer carrying body is in the range a diameter of 10 to 25 mm.

6. A developing apparatus according to claim 1, wherein a location on a surface of the developer between said first and second magnetic poles is higher than a location on a surface of said developer carrying body at which a density of a magnetic flux produced by said first magnetic pole is 200 gauss in a direction of a normal to a surface of said developer carrying body.

7. A developing apparatus according to claim 1, wherein respective diameters of said first and second screws are in the range of 10 to 25 mm.

8. A developing apparatus according to claim 1, further comprising voltage applying means for applying a voltage in which an AC and a DC voltage are superimposed to said developer bearing body.

9. A developing apparatus comprising:

a developer carrying body, opposed to an image bearing body bearing an electrostatic image, for carrying a magnetic developer;

a regulating member, provided under said developer carrying body, for regulating an amount of the developer on said developer carrying body;

a first magnetic pole provided in said developer carrying body and near to a portion regulated by said regulating member;

a second magnetic pole, provided at an upstream side of said first magnetic pole in a moving direction of said developer carrying body, for forming a repulsive magnetic field with said first magnetic pole;

a first screw for agitating and carrying a developer dropped from said developer carrying body by the repulsive magnetic field; and a second screw for forming a developer circulating path with said first screw and receiving a replenished developer, wherein developer-carrying capability of said first screw is lower than a developer-carrying capability of that of said second screw, and wherein a location on a surface of the developer between said first and second magnetic poles is higher than a location on a surface of said developer carrying body at which a density of a magnetic flux produced by said first magnetic pole is 200 gauss in a direction of a normal to a surface of said developer carrying body.

10. A developing apparatus according to claim 9, wherein a developer carrying speed of said first screw is lower than a developer carrying speed of said second screw.

11. A developing apparatus according to claim 10, wherein a pitch of said first screw is smaller than a pitch of said second screw.

12. A developing apparatus according to claim 9, wherein the developer includes a magnetic carrier and a toner, and said second screw is replenished with the toner.

13. A developing apparatus according to claim 9, wherein a diameter of said developer carrying body is in the range of 10 to 25 mm.

14. A developing apparatus according to claim 9, wherein respective diameters of said first and second screws are in the range of 10 to 25 mm.

15. A developing apparatus according to claim 9, further comprising voltage applying means for applying a voltage in which an AC and a DC voltage are superimposed to said developer bearing body.

16. A developing apparatus according to claim 1, further comprising a developing container including a developing chamber provided with said developer carrying body and said first screw, and an agitating chamber, provided with an opening allowing receiving of the replenished developer and said second screw, for forming the developer circulating path between said developing chamber.

17. A developing apparatus according to claim 9, further comprising a developing container including a developing chamber provided with said developer carrying body and said first screw, and an agitating chamber, provided with an opening allowing receiving of the replenished developer and said second screw, for forming the developer circulating path between said developing chamber.

* * * * *

UNITED STATES PATENT AND TRADEMARK OFFICE

CERTIFICATE OF CORRECTION

PATENT NO. : 6,473,584 B1
DATED : October 29, 2002
INVENTOR(S) : Masaru Hibino et al.

It is certified that error appears in the above-identified patent and that said Letters Patent is hereby corrected as shown below:

Title page,
Item [56], FOREIGN PATENT DOCUMENTS, “04204464 A” should read -- 4-204464 A --; “0608061 A” should read -- 6-089601 A --; “06208294 A” should read -- 6-208294 A”; and “07013420 A” should read -- 7-013420 A --.

Column 1,
Line 31, “a” (both occurrences) should be deleted; and
Line 58, “its” should read -- by its --.

Column 3,
Lines 32, 45 and 50, “above described” should read -- above-described --.

Column 5,
Line 44, “In” should read -- All --; and
Line 63, “above described” should read -- above-described --.

Column 6,
Line 35, “above described” should read -- above-described --;
Line 55, “above” should read -- above-described --; and
Line 56, “described” should be deleted.

Column 7,
Line 10, “above described” should read -- above-described --.

Column 8,
Lines 32 and 52, “above described” should read -- above-described --.

Column 9,
Lines 31 and 47, “above described” should read -- above-described --.

UNITED STATES PATENT AND TRADEMARK OFFICE

CERTIFICATE OF CORRECTION

PATENT NO. : 6,473,584 B1
DATED : October 29, 2002
INVENTOR(S) : Masaru Hibino et al.

It is certified that error appears in the above-identified patent and that said Letters Patent is hereby corrected as shown below:

Column 12,
Line 13, "the range a diameter" should read -- a range --; and
Line 14, "diameter" should be deleted.

Signed and Sealed this

Fifteenth Day of July, 2003

JAMES E. ROGAN
*Director of the United States Patent and Trademark Office*